US005330055A

United States Patent [19]

Kendra et al.

[11] Patent Number: 5,330,055

[45] Date of Patent: Jul. 19, 1994

[54] PACKAGE ASSEMBLY FOR SEPARATELY PACKAGING, DISPLAYING, AND DISPENSING A PLURALITY OF ARTICLES

[75] Inventors: Robert T. Kendra, Irwin; Philip H. Weihl, Greensburg; Thomas J. Baric, Trafford, all of Pa.; Kent W. Murphy, Wooster, Ohio; Edward L. Bejster, Latrobe, Pa.; Harry C. Dundore, Rome, Ohio

[73] Assignee: Kennametal Inc., Latrobe, Pa.

[21] Appl. No.: 62,372

[22] Filed: May 12, 1993

Related U.S. Application Data

[63] Continuation-in-part of Ser. No. 938,638, Aug. 31, 1992.

[51] Int. Cl.[5] ..... B65D 73/02

[52] U.S. Cl. ..... 206/534.1; 206/538; 206/539; 206/504; 206/509; 220/23.4

[58] Field of Search ..... 206/534.1, 534.2, 538, 206/539, 504, 509, 511, 459.5; 220/23.4, 342

[56] References Cited

U.S. PATENT DOCUMENTS

| | | | |
|---|---|---|---|
| 3,182,856 | 5/1965 | Goltz | 206/509 |
| 3,214,057 | 10/1965 | Box . | |
| 3,380,578 | 4/1968 | Sparks | 206/390 |
| 3,424,334 | 1/1969 | Goltz . | |
| 3,642,337 | 2/1972 | Manheim | 206/509 |
| 3,647,105 | 3/1972 | Keesler . | |
| 3,737,031 | 6/1973 | Carroll | 206/504 |
| 3,760,937 | 9/1973 | Van Wyngarden et al. . | |
| 3,851,936 | 12/1974 | Muller | 206/504 |
| 4,038,937 | 8/1977 | Moe | 206/538 |
| 4,062,445 | 12/1977 | Moe | 206/538 |
| 4,372,445 | 2/1983 | Keffeler | 206/538 |
| 4,619,363 | 10/1986 | Wolfseder . | |
| 4,660,724 | 4/1987 | Gaynes . | |
| 4,660,725 | 4/1987 | Fishman et al. . | |
| 4,872,559 | 10/1989 | Schoon | 206/538 |
| 4,982,858 | 1/1991 | von Holdt . | |
| 5,240,113 | 8/1993 | Gibilisco | 206/538 |

*Primary Examiner*—David T. Fidei
*Attorney, Agent, or Firm*—James G. Porcelli

[57] ABSTRACT

A package assembly formed from two detachably connectable package modules is provided for separately packaging a plurality of articles, such as machine tool cutting inserts. Each package module is substantially structurally identical to the other module, and comprises a tray having a top portion, a bottom wall, side walls, and a plurality of spaced-apart interior walls that define a plurality of article-holding chambers, a transparent lid slidably mounted on the top portion of the tray for retaining, displaying, and sequentially dispensing articles disposed in the article-holding chamber of the tray. Each tray further comprises a cantilevered lip on the exterior of the tray for releasably interconnecting the side walls of the trays of two different package modules such that the bottom wall of the tray of one module and the transparent lid of the other module face the same direction. A label concerning the nature of the articles may be applied to the bottom wall of the tray or to the lid of each module. When the label is applied to the bottom wall, the horizontal interconnection provided by the cantilevered lips on the modules allows the user of the articles to advantageously see not only the articles themselves through the transparent lid of one module, but the printed information on the label of another module at the same time. Additionally, the releasable interconnection provided by the cantilevered lip on each module allows the user to easily break the package assembly in half without compromising the packaging integrity of the inserts or other articles contained within the individual modules.

25 Claims, 2 Drawing Sheets

36a
42
36b
5
55
1'
7'
7
19b
53
9b
21
1
9a
19a
59
40
4B
38e
39e
44d
39d
38d
44c
38c
39c
44b
38b
39b
44a
38a
39a
24
9b

PACKAGE ASSEMBLY FOR SEPARATELY PACKAGING, DISPLAYING, AND DISPENSING A PLURALITY OF ARTICLES

BACKGROUND OF THE INVENTION

This application is a continuation-in-part of U.S. design patent application Ser. No. 07/938,638 filed Aug. 31, 1992.

This application generally relates to packaging, and is specifically concerned with a packaging assembly formed from two releasably connectable package modules for separately packaging, displaying, and dispensing a plurality of articles, such as the cutting inserts used in metalworking machinery.

Various types of packaging for metalcutting inserts are known in the prior art. However, before the specialized nature of such packaging can be fully appreciated, some brief background is necessary concerning both the physical characteristics of the inserts, as well as the environment in which they are used.

Metalcutting inserts are used to cut and shape metal machine components in metalworking machinery such as lathes, drills, routers, and threading machines. Despite the large amounts of metal that each insert typically cuts in its lifetime, the actual dimensions of most inserts are quite small (i.e., less that one inch across). In use, such inserts are clamped or otherwise secured in a toolholder in the metalworking machine, which manipulates and forcefully engages a cutting edge of the insert against the metal being machined. Because they are formed from very hard sintered tungsten carbide, ceramic or cermet compositions, the cutting edges of such inserts are brittle, and are prone to chipping if bumped against another insert or otherwise exposed to significant shock. Additionally, because the cutting edges of a typical insert may only have a life expectancy of about an hour of hard machining, the machinist must unclamp a spent, dull insert from his cutting tool several times a day and replace it with a fresh insert from an insert package.

As a consequence of their brittle nature, the packaging for such inserts must protect the inserts from outside shock and prevent the cutting edges of adjacently packaged inserts from bumping against each other and chipping during transit from the insert manufacturer to the machinist. To this end, most prior art packaging arrangements provide a protective, plastic wall of material, individually around each insert. To facilitate the frequent need to replace a dull insert with a new one, some prior art packages have a sliding lid designed to dispense the new inserts contained inside.

In addition to these basic features, the applicants have noted a number of other features that would be highly desirable in such packaging. For example, the packaging should readily and immediately inform the machinist as to the precise type of inserts being stored therein so that the machinist can easily confirm that the packaged inserts are the type needed for a particular job. Additionally, while most insert packages presently in the industry are designed to contain ten cutting inserts, the lengthening lifetimes of such inserts due to advances in material sciences, along with the proliferation of small-volume machining operations, have led the applicants to conclude that it would be highly desirable for an insert package to optionally accommodate either five or ten inserts. Such optional accommodation of fewer inserts should occur without compromising the integrity of the package or the protection afforded the inserts. The packaging should further allow the machinist to quickly and positively dispense the inserts contained therein in order to minimize the time spent replacing dull inserts with new ones in the lathe or other machine tool where the inserts are being used. Moreover, the packaging should allow the inserts to be individually dispensed. If more than one insert is dispensed into the hand of a machinist at one time, the edges of the inserts might bump against each other, or one or more of the inserts might be dropped. In either case, unwanted chipping of the brittle insert edges might occur.

It would also be desirable if the packaging were compatible with automatic loading machinery, so that the packages could be quickly and efficiently loaded with inserts without the need for human labor. Further, if the packaging were stackable and laterally unitizable, space could be conserved during shipping and storing operations, the taking of inventory would be facilitated, and the shock-absorption capabilities of the resulting array of packages would be maximized. Finally, such packaging should be reusable over a long life span, like deposit soft drink bottles, to reduce the overall expense associated with the packaging, and formed from recyclable plastics or other materials so that new packaging can be fabricated from worn-out packaging.

Presently, the applicants are not aware of any insert packaging that completely fulfills all of the aforementioned criteria. Clearly, there is a need for such packaging.

SUMMARY OF THE INVENTION

Generally speaking, the invention is a package assembly that fulfills all of the aforementioned criteria. The new package assembly is formed from two detachably connectable package modules, each of which separately packages, displays, and dispenses a plurality of articles, such as cutting inserts, wherein each module is substantially structurally identical to the other.

Moreover, each of the package modules comprises an elongated tray having a top portion, a bottom wall, sidewalls, and a plurality of spaced-apart interior walls traversing its longitudinal axes for defining a plurality of article holding chambers, a lid for retaining, displaying, and sequentially dispensing the articles disposed in the chambers of the tray, and a cantilevered lip for detachably interconnecting the sidewalls of the trays of two different package modules such that the bottom wall of the tray of one module and the lid of the other module face the same direction.

The outer surface of the bottom wall of the tray may include a labeling film for displaying written information concerning the nature of the articles packaged in the assembly, such that once a user picks up a particular package assembly, he simultaneously sees not only the articles themselves through the lid of one module, but also the written information concerning the articles printed on the outer surface of the bottom wall of the other module. This is advantageous when the package assembly is used to package inserts used by machinists, as the machinist can easily and immediately identify the particular kind of insert packaged by the assembly by merely glancing at it. Additionally, the fact that the package modules forming the assembly can be easily detached from one another allows the consumer of the articles packaged therein to buy fewer of the articles, if desired, without compromising the integrity of the packaging structure that surrounds and protects the articles.

Each package module preferably includes a means for detachably connecting the bottom wall of the tray of one module with the top portion of the tray of another module to render the modules vertically stackable and vertically unitized. In the preferred embodiment, such detachable connecting means includes a pair of parallel ribs protruding from the bottom wall of the tray of one module that resiliently engage the top edges of the tray of another module. This feature, in combination with cantilevered lips that allow two modules to be releasably interconnected along their sidewalls, provides both a horizontal and vertical unitizing capability. Hence the individual modules can be joined in a fashion which not only facilitates the storing and shipping of the articles contained within the modules, but the taking of an inventory of the articles as well.

Each package module may further include a detent means for stopping the slidable movement of the lid in the tray whenever the lid completely uncovers one of the article chambers. In one embodiment, the detent means is formed from a pair of opposing recesses in the lid which catch onto opposing beads integrally molded into the tray. The beads are received within the recesses whenever the lid is slid to a position uncovering another one of the chambers in the tray.

A similar arrangement may be incorporated between the tapered ends of the parallel flanges of one tray and the parallel ribs protruding from the bottom wall of another tray such that the sliding motion between unitized trays may be stopped.

The lid may include a finger-receiving recess for facilitating the gripping and sliding thereof by the user. A magnifying lens may be integrally molded into the transparent plastic or other material forming the lid to provide a magnified image of the article being held within the module.

The tray and lid of each module is preferably formed from a recyclable plastic material, in order to render each module not only reusable, but completely recyclable as well. Finally, the elongated shape of the tray and the sliding connection between the top portion of the tray and the lid not only allow each module of the assembly to sequentially and individually dispense an article, but also render the module of the invention compatible with article loading machinery.

BRIEF DESCRIPTION OF THE SEVERAL FIGURES

DETAILED DESCRIPTION OF THE PREFERRED EMBODIMENT

Figures 1, 2, 3:
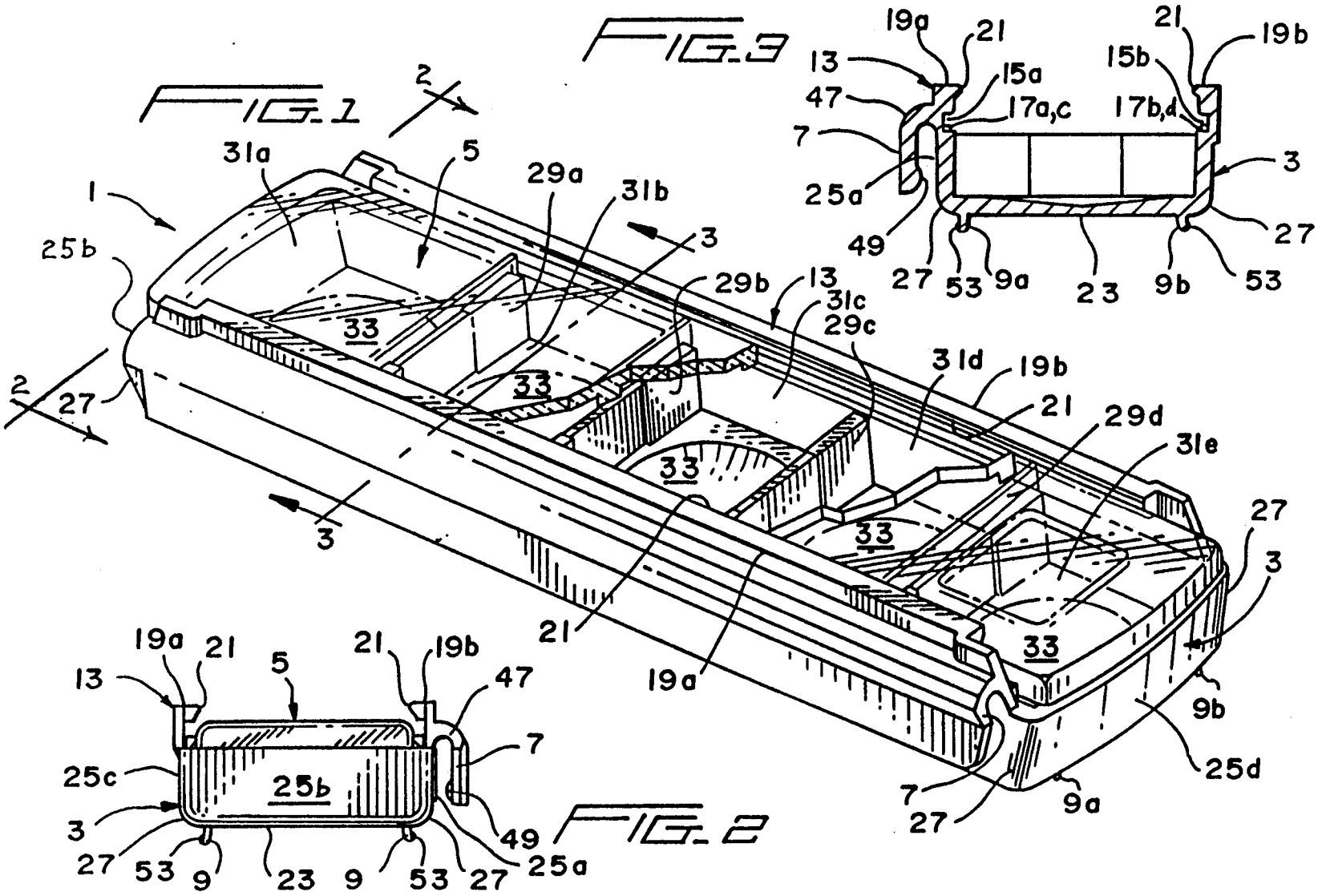
FIG. 1 is a perspective view of the package module of the invention.
FIG. 2 is a side view of the module illustrated in FIG. 1 along the line 2—2.
FIG. 3 is a cross-sectional side view of the module illustrated in FIG. 1 along the line 3—3 with the lid removed from the tray of the module.

With reference now to FIGS. 1, 2, and 3 wherein like numerals designate like components throughout all the several figures, the package module 1 of the invention generally comprises an elongated tray 3 over which a transparent lid 5 is slidably mounted. A cantilevered lip 7 extends from one of the sidewalls of the tray 3 in order to render the module 1 releasably interconnectable with the cantilevered lip 7 of another package module 1' to form the package assembly 55 illustrated in FIG. 5. A pair of opposing, parallel ribs 9*a,b* extend out from the bottom of the elongated tray 3 in order to render the module 1 vertically stackable with another such module, as will be described in more detail hereinafter.

With reference to FIG. 3, the tray 3 of the module 1 includes a top portion 13 having a pair of opposing, parallel slots 15*a,b* best seen in FIG. 3. Two pairs of opposing, bead-like detents 17*a–d* (of which only 17*a,b* are shown) are disposed along the parallel slots 15*a,b* at either end of the tray 3 for a purpose which will become evident shortly. Disposed above the parallel slots 15 are a pair of parallel flanges 19*a,b*, each of which terminates in a tapered end 21 as shown. The detents 17*c,d* are located along the parallel slots and are distanced from the side wall 25*b* approximately the same amount as detents 17*a,b* are distanced from the side wall 25*d*.

In an alternative embodiment, bead-like detents may be disposed along one of the parallel slots 15*a,b* on only a single side of the tray. Furthermore, while the detents 17*a–d* shown in FIG. 3 are on a horizontal surface of the slots 15*a,b*, the detents may alternatively be on a vertical surface of the slots 15*a,b*.

Figures 4A, 4B, 4C, 5, 6:
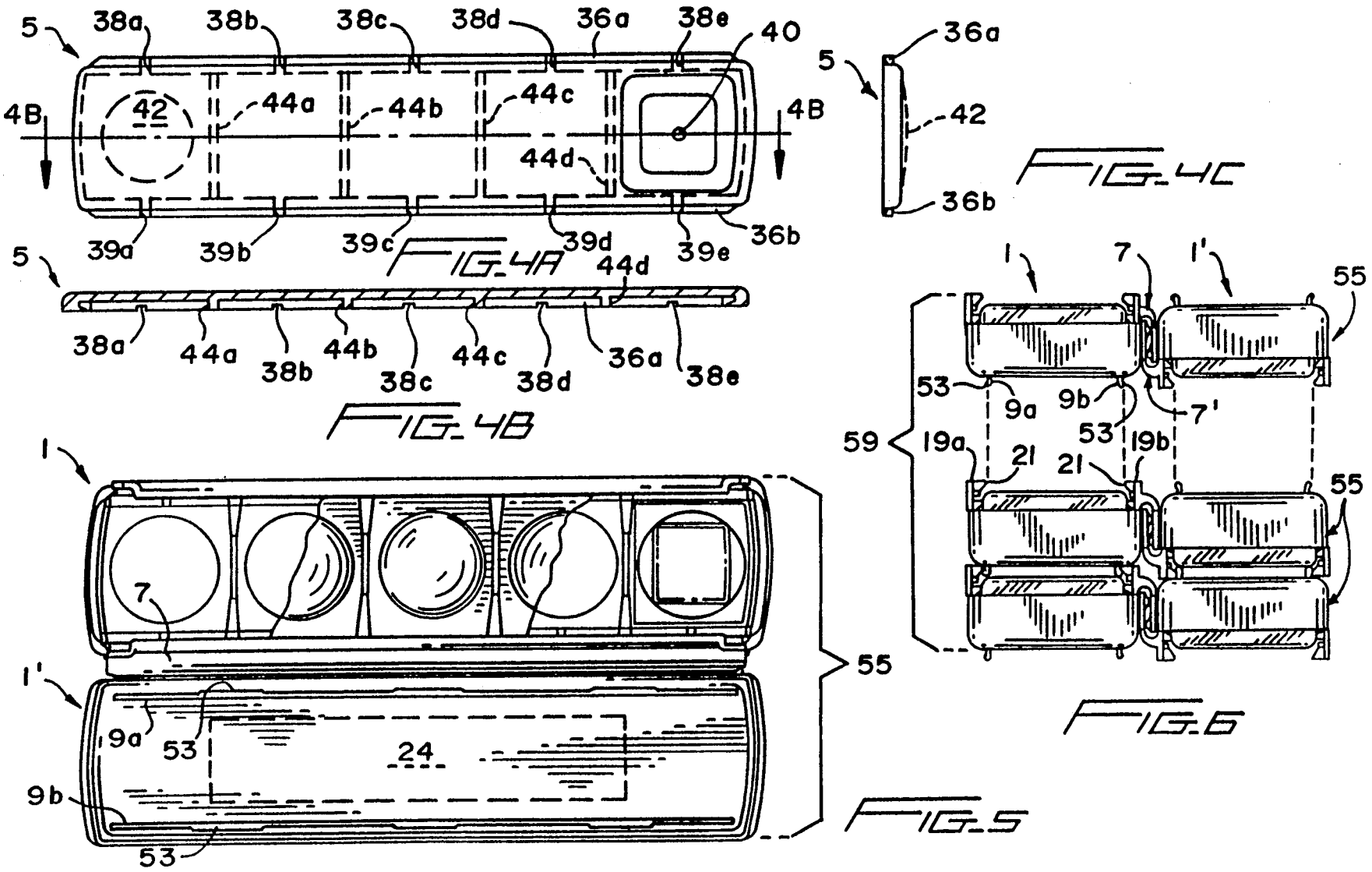
FIGS. 4A, 4B and 4C are a plan view, cross-sectional side view, and end view of the lid of the packaging module, respectively.
FIG. 5 is a plan view of two modules releasably interconnected together to form the package assembly of the invention.
FIG. 6 is an end view of a vertically unitized stack of the packaging assemblies of the invention.

With reference now to FIGS. 2, 3, and 5, the elongated tray 3 of the package module 1 further includes a bottom wall 23. The outer surface of the bottom wall 23 may include a label film 24 (shown in phantom in FIG. 5) which is specifically designed to carry and display written information concerning the contents of the module 1. However, such a label film may also be placed on the top surface of the transparent lid 5. Sidewalls 25*a–d* interconnect the bottom wall 23 with the previously described top portion 13. These walls interconnect one another by means of rounded joints 27. Such rounded joints 27 are preferred over the sharply angular joints associated with the prior art, as the arcuate contours of such joints are less apt to rupture blister packing or tear through envelope packaging when the package module 1 is used as a shipping container. Located in the interior of the elongated tray 3 are four interior walls 29*a–d* which are disposed orthogonally with respect to the longitudinal axis of the tray 3. These interior walls 29*a–d* define five article-holding chambers 31*a–e* which, in the preferred embodiment, are shaped like flattened cubes. The flattened cube shape of each of the chambers 31*a–e* maximizes the number of types of cutting inserts (or other objects) that a particular module 1 can safely contain and protect. As an optional feature, a shallow, concave indentation 33 may be provided on the floor of each of the article holding chambers 31*a–e*. These concave indentations 33 help to center the article contained within the chambers 31*a–e* when the bottom wall 23 is oriented downwardly as shown in FIGS. 1, 2, and 3. In the preferred embodiment, the elongated tray 3 is preferably formed from a recyclable plastic material, such a polystyrene.

With reference now to FIGS. 4A, 4B, and 4C, the lid 5 of the module 1 is preferably transparent and likewise formed from a recyclable plastic material, such as K-Resin® copolymer. K-Resin® is a trademark of the Phillips Petroleum Company to describe a series of styrene-butadiene copolymers. The lid 5 includes a pair of opposing side rails 36*a,b* which are slidably movable within the previously described parallel slots 15*a,b* located on the top portion 13 of the elongated tray 3. The side rails 36*a,b* include five opposing pairs of detent-receiving notches 38*a–e* and 39*a–e*, respectively. Each opposing pair of notches is engagable with one of the two pairs of detents 17*a,b* and 17*c,d* located within the slots 15*a,b* on the top portion 13 of tray 3. The relative longitudinal spacing of the notches 38*a–e* and 39*a–e* with the pairs of detents 17*a,b* and 17*c,d* on the top portion 13 of the tray 3 is such that whenever one or both of the pairs of detents 17*a,b* or 17*c,d* is snapped into registry with one of the pairs of notches 38*a–e* and 39*a–e*, the lid 5 has completely uncovered one of the article holding chambers 31*a–e*. This feature greatly aides the dispensing function of the module 1, as the user knows that whenever the detents 17*a,b* and 17*c,d* snap into the opposing pairs of notches 38*a–e* and 39*a–e* on the lid 5, that the lid 5 has completely cleared another one of the chambers 31*a–e*, whereupon the article in the chamber may be freely removed. As is indicated in phantom is FIG. 4A, a magnifying lens 42 may be integrally molded into the transparent plastic material forming the lid 5, if desired. The lid 5 may also include a finger-receiving recess 40 for facilitating the gripping and sliding of the lid 5. Finally, as is best seen in FIGS. 4A and 4B, transverse reinforcing ribs 44*a–d* may be integrally formed on the underside of the lid 5 for strengthening purposes. These reinforcing ribs 44*a–d* are spaced apart the same distance as the interior walls 29*a–d* in the tray 3 so that they will not interfere with the view of the inside of the article-holding chambers 31*a–e*.

An alternative embodiment for the bead-like detents along the parallel slots 15*a,b* of the tray 3 was previously discussed in which the detents were disposed on a vertical surface within one or both of the slots 15*a,b*. Consistent with that, an alternative embodiment of the lid 5 involves positioning the notches 38*a–e* within the side rails 36*a,b* such that they engage the detents on the vertical surface of the slots 15*a,b*. While not shown, the plan view of FIG. 4A would have horizontal indentations where items 38*a–e* and 39*a–e* now appear.

With reference in particular to FIGS. 3, 5, and 6, the cantilevered lip 7 of the package module 1 includes a rounded section 47 which orients the underside of the lip 7 parallel with sidewall 25*a* of the tray 3. The lip 7 further terminates in a retention bead 49 as shown. The spacing of the underside of the lip 7 from the sidewall 25*a* and the dimensions of the retention bead 49 are such that the cantilevered lip 7 of one module 1 can releasably capture the cantilevered lip 7' of another module 1' as is shown in FIG. 6. When two such modules 1 and 1' are releasably and horizontally interconnected via their cantilevered lips 7 and 7', they form the package assembly 55 illustrated in FIG. 5. Such a packaging assembly 55 can advantageously be broken back down into two individual package modules 1 and 1' by sliding the cantilevered lips 7 and 7' out of engagement from one another. Additionally, because the transparent lid of one module 1 and the bottom wall 23 of the other module 1' always face the same direction, the user of the articles contained within the package assembly 55 can see a label with written information describing the articles, whether the label is on the lid 7 or the bottom wall 23 of a module. However, a label having transparent portions should be used when the label is on the lid 5 so that the tray contents may still be seen.

While not shown in the figures, a small protrusion may be extended from the tray wall 25*a* beyond each end of the cantilevered lip 7 so that when two modules are horizontally coupled, the tendency for the modules to shift within the engaged cantilevered lips 7 and 7' will be minimized.

FIG. 6 illustrates how a plurality of package assemblies 55 may be detachably connected in the vertical direction to form a unitized stack 59. Specifically, because the distance between the tapered ends 21 of the parallel flanges 19*a,b* on the top portion 13 of each module 1 is slightly less than the distance between the retention feet 53 disposed OD the outside of the parallel ribs 9*a,b*, these retention feet 53 may be snap-fitted within the tapered ends 21 of the flanges 19 as is seen in FIG. 6. Additionally, to enhance the bond with the tapered ends 21 of the flanges 19, the retention feet 53 may be slightly angled toward the module side walls 25*a,c* as illustrated in FIGS. 2 and 3. With such an arrangement, there exists contact between mating retention feet 53 and flanges 19*a,b* and any tendency for sliding between these elements would be resisted by friction as a result of the contact between them. However, to further counter any tendency for these elements to slide relative to one another, while not shown in the figures, it is possible to provide a pair of beads extending outwardly from one or both of the feet 53 with a distance between each pair greater than the length of the tapered ends 21 of flanges 19*a,b*. In this manner, when modules are vertically engaged through resilient contact between retention feet 53 and tapered ends 21, the beads on the retention feet 53 may be positioned to restrain horizontal movement of the feet 53 with respect to the tapered ends 21 of the flanges 19*a,b*.

While FIG. 6 specifically shows how packaging assemblies 55 formed from two horizontally interconnected modules 1, 1' may be vertically stacked together, it is also possible to vertically stack individual package modules 1 which are not horizontally interconnected to another module 1' if desired.

While the invention has been described with reference to a specific embodiment thereof, various modifications, additions, and improvements, will be apparent to a person having ordinary skill in the packaging arts. All such modifications, additions, and improvements are intended to be encompassing within this invention, which is limited only by the claims appended hereto.

What is claimed is:

1. A package module for separately packaging a plurality of articles, comprising:

a tray means for holding articles and having an axis, including a top portion, a bottom wall, sidewalls, and a plurality of spaced-apart walls traversing said axis for defining a plurality of article holding chambers;

a lid means for covering the tray means, said lid means being slidably mounted on the top portion of said tray means for sequentially uncovering said chambers to sequentially dispense said articles when slid along said axis;

means for releasably interconnecting a sidewall of the tray means of two different package modules to form a single package assembly from two package modules, and means for detachably connecting the bottom wall of the tray means of one package module with the top portion of the tray means of another package module to render said modules vertically stackable into a compact and shock absorbent assembly.

2. The package module of claim 1, wherein said interconnecting means releasably interconnects two different package modules such that the bottom wall of the tray means of one module face the same direction as the lid means of the other package module.

3. The package module of claim 2, wherein said lid means is transparent at least in part for displaying articles disposed within the article holding chambers of the tray means.

4. The package module of claim 3, wherein said interconnecting means includes a cantilevered lip on a sidewall of the tray means of one module that is releasably interlockable with the same type of cantilevered lip on a sidewall of the tray means of another module.

5. The package module of claim 1, further comprising means for detachably connecting the bottom wall of the tray means of one package module with the top portion of the tray means of another package module to render said modules vertically stackable.

6. The package module of claim 1, wherein said detachable connecting means includes a pair of ribs protruding from the bottom wall of the tray means of one module that resiliently engage top edges of the tray means of another module.

7. The package module of claim 1, further comprising detent means for stopping the slidable movement of said lid means in said tray means whenever said lid means completely uncovers one of said article chambers.

8. The package module of claim 1, wherein said tray means is elongated, and said lid means is slidably moveable along the longitudinal axis of said tray means.

9. The package module of claim 1, wherein said lid means includes a finger-receiving recess for facilitating the gripping and sliding of said lid means.

10. A package assembly formed from two releasably connectable package modules for separately packaging and displaying a plurality of articles, each module being substantially structurally identical to the other module, wherein each module comprises:

a tray means for holding articles and having an axis, including a top portion, a bottom wall including label means for displaying written information concerning said articles, sidewalls, and a plurality of spaced-apart interior walls traversing said axis for defining a plurality of article holding chambers;

a lid means for retaining, displaying, and sequentially dispensing articles disposed in the article holding chambers of the tray means, and means for releasably interconnecting a sidewall of the tray means of two different package modules such that the label means on the tray bottom wall of the tray means of one module and the lid means of the other module face the same direction for simultaneously displaying articles in a first module along with said written information concerning said articles in a second module releasably interconnected to said first module.

11. The package assembly of claim 10, wherein said lid means is slidably mounted on the top portion of the tray means for sequentially uncovering said article holding chambers when slid along said axis.

12. The package assembly of claim 11, wherein said lid means is formed at least in part from a transparent material.

13. The package assembly of claim 11, further comprising detent means for stopping the slidable movement of said lid means in said tray means whenever said lid means completely uncovers one of said article chambers.

14. The package assembly of claim 10, wherein said tray means is elongated, and said interior walls are substantially parallel with respect to one another.

15. The package assembly of claim 10, wherein said interconnecting means consists of a single cantilevered lip on a sidewall of the tray means of one module that is releasably interlockable with the same type of cantilevered lip on a sidewall of the tray means of another module.

16. The package assembly of claim 10, further comprising means for detachably connecting the bottom wall of the tray means of one package module with the top portion of the tray means of another package module to render said modules vertically stackable.

17. The package assembly of claim 16, wherein said detachable connecting means includes a pair of ribs protruding from the bottom wall of the tray means of one module that resiliently engage top edges of the tray means of another module.

18. The package assembly of claim 10, wherein the bottom wall of the tray means includes a plurality of concave depressions for centering an article disposed within said article holding chambers.

19. A package assembly formed from two releasably connectable package modules for separately packaging, displaying, and dispensing a plurality of cutting inserts, wherein each module comprises:

an elongated tray means for holding articles, including a top portion, a bottom wall, sidewalls, and a plurality of spaced-apart interior walls orthogonally traversing the longitudinal axis of said tray means for defining a plurality of insert holding chambers;

a transparent lid means for retaining, displaying, and sequentially dispensing inserts disposed in the insert holding chambers of said tray means, said lid means being slidably mounted on the top portion of said tray means for sequentially uncovering said chambers when slid along said longitudinal axis, and means for releasably interconnecting a sidewall of the tray means of two different package modules such that the bottom wall of the tray means of one module and the lid means of the other module face the same direction, consisting of a single cantilevered lip on a side wall of the tray means of one module that is releasably interlockable with the same type of single cantilevered lip on a sidewall of the tray means of another module.

20. The package assembly of claim 19, further comprising means for detachably connecting the bottom wall of the tray means of one package module with the top portion of the tray means of another package module to render said modules vertically stackable, wherein said detachable connecting means includes a pair of ribs protruding from the bottom wall of the tray means of one module that resiliently engage top edges of the tray means of another module.

21. The package assembly of claim 19, wherein the bottom wall of the tray means includes a plurality of concave depressions for centering an insert disposed within said insert holding chambers.

22. The package assembly of claim 19, wherein said lid means includes a finger-receiving recess for facilitating the gripping and sliding of said lid means.

23. The package assembly of claim 19, wherein the lid means is slidably movable away from said tray means in either direction along said longitudinal axis such that inserts can be sequentially dispensed from either end of said tray means.

24. The package assembly of claim 19, wherein said tray means and lid means are formed from recyclable plastic material.

25. The package assembly of claim 19, wherein each of said inserts includes two opposing sides that have a larger area than the other sides of the same insert, and each of said chambers displays one of said two larger area sides of said inserts when an insert is disposed within it.

* * * * *